US009553411B2

(12) United States Patent
Reinhardt et al.

(10) Patent No.: US 9,553,411 B2
(45) Date of Patent: Jan. 24, 2017

(54) ELECTRONIC INTERFACE

(71) Applicant: Tyco Electronics AMP GmbH, Bensheim (DE)

(72) Inventors: Marc Reinhardt, Bensheim (DE); Frank Flittner, Alsbach-Haehnlein (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 14/633,817

(22) Filed: Feb. 27, 2015

(65) Prior Publication Data

US 2015/0171563 A1 Jun. 18, 2015

Related U.S. Application Data

(63) Continuation of application No. PCT/IB2013/056634, filed on Aug. 14, 2013.

(30) Foreign Application Priority Data

Aug. 30, 2012 (DE) ..... 10 2012 215 377

(51) Int. Cl.

| | |
|---|---|
| ***H01R 13/6582*** | (2011.01) |
| ***H01R 13/516*** | (2006.01) |
| ***H01R 13/6581*** | (2011.01) |
| *H01R 12/71* | (2011.01) |

(52) U.S. Cl.

CPC ..... *H01R 13/6582* (2013.01); *H01R 13/516* (2013.01); *H01R 13/6581* (2013.01); *H01R 12/716* (2013.01)

(58) Field of Classification Search

CPC ..... H01R 13/6582; H01R 13/6581; H01R 13/516; H01R 12/716

USPC ..... 439/607.4, 357, 660, 607.01, 607.47,439/607.53, 607.54, 607.55, 607.56, 540.1,439/541.5, 607.09, 607.13, 607.35

See application file for complete search history.

(56) References Cited

U.S. PATENT DOCUMENTS

| | | | | |
|---|---|---|---|---|
| 6,007,381 | A | 12/1999 | Ando et al. | |
| 6,135,790 | A | 10/2000 | Huang et al. | |
| 6,210,231 | B1 | 4/2001 | Lai | |
| 6,217,378 | B1 | 4/2001 | Wu | |
| 7,273,397 | B2 | 9/2007 | Watanabe et al. | |
| 7,442,066 | B1 | 10/2008 | Ho et al. | |
| 7,744,382 | B2 | 6/2010 | Zheng et al. | |
| 7,824,222 | B2 | 11/2010 | Miyoshi et al. | |
| 7,833,058 | B2 * | 11/2010 | Zhang | H01R 13/508 439/607.41 |

(Continued)

FOREIGN PATENT DOCUMENTS

CN 201774094 U 3/2011

OTHER PUBLICATIONS

Bibliographic Data Abstract for CN201774094, dated Mar. 23, 2011, 1 page.

(Continued)

*Primary Examiner* — Abdullah Riyami
*Assistant Examiner* — Harshad Patel
(74) *Attorney, Agent, or Firm* — Barley Snyder

(57) ABSTRACT

An electronic interface is provided and includes a shield having a first shield element, a second shield element, and a connection section. The second shield element is spaced apart from the first shield element along a length of the shield and has a width different than a width of the first shield element. The connection section electrically connects the first shield element and the second shield element.

10 Claims, 4 Drawing Sheets

(56) References Cited

U.S. PATENT DOCUMENTS

| | | | | |
|---|---|---|---|---|
| 7,927,142 | B2 | 4/2011 | Wang et al. | |
| 8,007,323 | B1 * | 8/2011 | Yao | H01R 13/405 439/660 |
| 8,038,480 | B2 * | 10/2011 | Wei | H01R 13/502 439/607.01 |
| 2006/0154524 | A1 | 7/2006 | Huang et al. | |
| 2007/0105440 | A1 | 5/2007 | Delaney et al. | |
| 2008/0214050 | A1 | 9/2008 | Ishizuka et al. | |
| 2009/0325417 | A1 | 12/2009 | Ko | |
| 2010/0062642 | A1 | 3/2010 | Zhang et al. | |
| 2011/0207371 | A1 | 8/2011 | Tung et al. | |
| 2011/0256773 | A1 * | 10/2011 | Hsu | H01R 12/724 439/626 |

OTHER PUBLICATIONS

PCT Search Report issued in co-pending International application No. PCT/IB2013/056634, dated Apr. 12, 2013, 3 pages.

* cited by examiner

ELECTRONIC INTERFACE

CROSS-REFERENCE TO RELATED APPLICATIONS

This application is a continuation of PCT International Application No. PCT/IB2013/056634 filed Aug. 13, 2013, which claims priority under 35 U.S.C. §119 to German Application 102012215377.2, filed Aug. 30, 2012.

FIELD OF THE INVENTION

The invention relates to an electronic interface and, in particular, to a USB interface.

BACKGROUND

A large number of electronic connectors are known in electrical engineering and electronics that are used to transmit electrical signals or voltages and optionally electrical currents with the largest possible range of voltages, data rates or frequencies and optionally electrical currents. In particular, in the automotive sector, electronic interfaces for such connections must permanently ensure correct transmission of electronic signals or data and optionally electrical power with significant temperature loading in a passenger compartment with a large number of insertion cycles.

Such known electronic interfaces can be fitted to an electronic cable or to/in an electronic device, generally a printed circuit board or a card, of an electrical, electronic or electro-optical device. If the interface is located on a cable, it is usually referred to as a (floating) plug type and/or socket connector, or a connector or a coupling; if the interface is located on/in an electronic device of an apparatus, it is usually referred to as a flush type contact device or a flush type socket, also referred to as a header.

Universal Serial Bus (USB) interfaces are currently popular. Accordingly, reference is made to USB connectors, for example, the increasingly popular mini-USB or micro-USB connectors or interfaces. Furthermore, other interfaces such as, for example, DVI, SDI, DisplayPort, etcetera, are naturally known.

Attempts have been made to improve USB interfaces or connectors and, in particular, USB interfaces or connectors having greater electromagnetic shielding. For example, mini-USB and micro-USB interfaces have a greater dimension in at least one transverse direction than an interface region of the same interface in the same transverse direction owing to an increase in spacings between the contact elements in a base region. Accordingly, such a design results in two-part shielding. Other known shielding techniques, which shielding that are connected along one side between the base region and the interface region. In both known designs, a significant empty space, generally a slot, of approximately 270° in a peripheral direction exists between the base region and the interface region of the shielding, which has a negative effect on shielding quality and consequently a negative effect on a data transmission rate of the interface.

SUMMARY

An object of the invention is to provide an improved electronic interface and, in particular an improved USB interface. Accordingly, an electronic interface according to the invention is provided and includes a shield having a first shield element, a second shield element, and a connection section. The second shield element is spaced apart from the first shield element along a length of the shield and has a width different than a width of the first shield element. The connection section electrically connects the first shield element and the second shield element.

BRIEF DESCRIPTION OF THE DRAWINGS

The invention is explained in greater detail below with reference to embodiments and the appended drawings. In the Figures of the drawings.

DETAILED DESCRIPTION OF THE EMBODIMENT(S)

Now with reference to the drawings, an embodiment of an electronic interface 1 according to the invention will be discussed.

Figure 2:
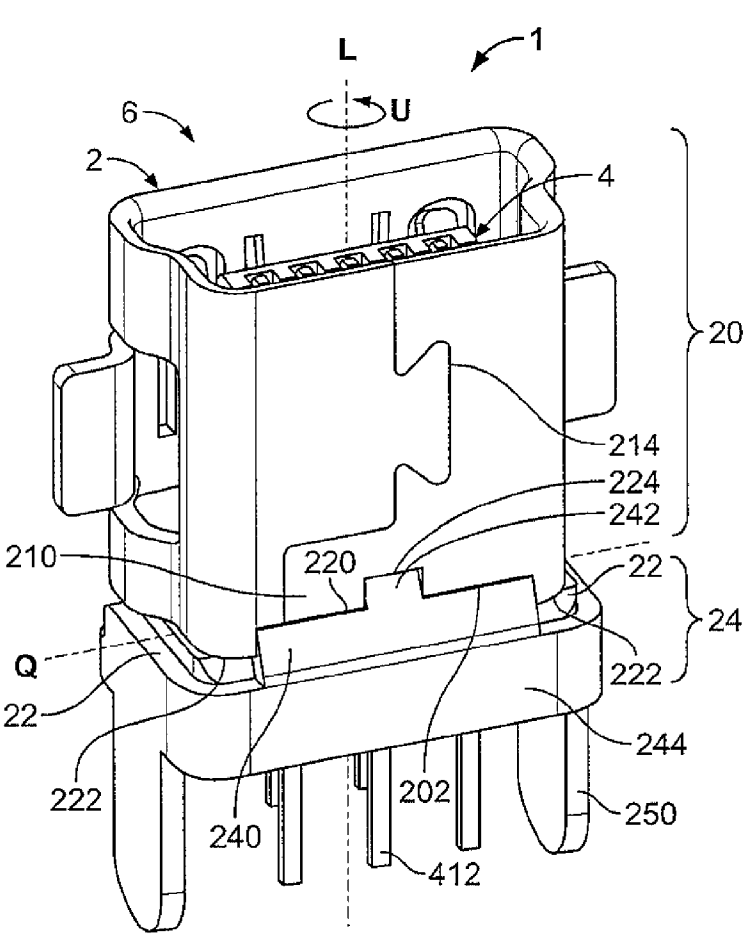
FIG. 2 is a rear perspective of the electronic interface of FIG. 1.
Figure 1:
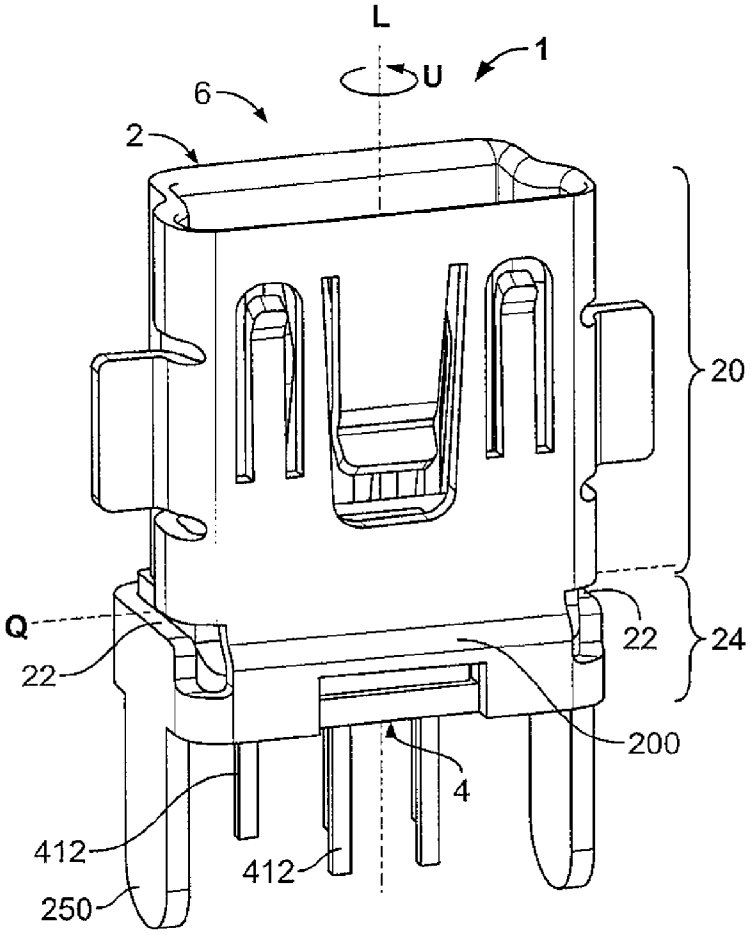
FIG. 1 is a front perspective side view of an electronic interface according to the invention.
Figure 3:
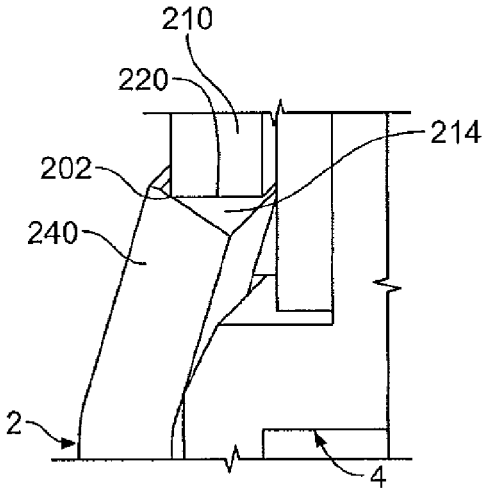
FIG. 3 is a close-up cross-section of the electronic interface from FIG. 2 in a connection region between a base and a shield.
Figure 8:
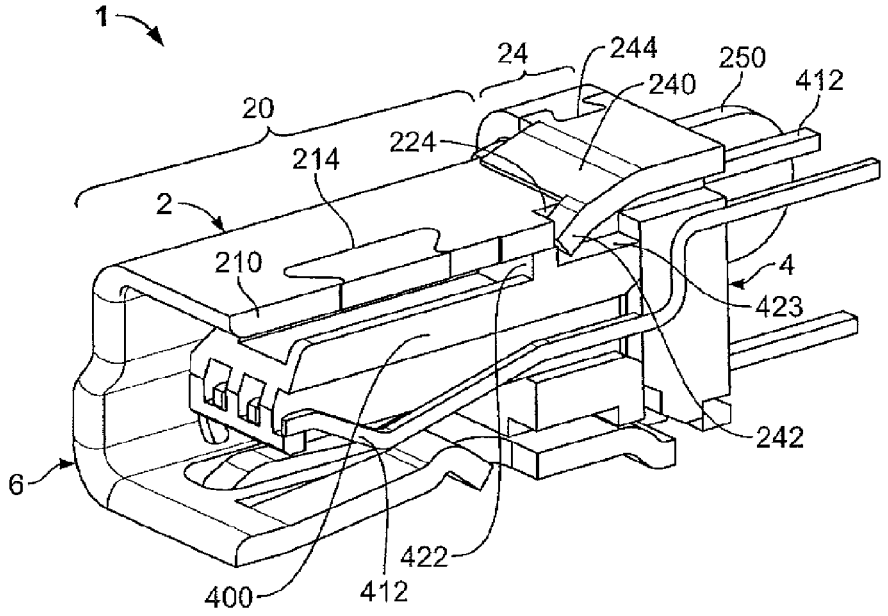
FIG. 8 is a section perspective view of the electronic interface of FIG. 7 after assembly thereof.

As shown in FIGS. 1, 2, 8, the electronic interface 1 is in the form of a USB interface and, in particular, a mini-USB or micro-USB interface. However, the invention is not limited to the embodiment illustrated but may in principle be applied to all electronic interfaces. Thus, for example, it is possible to apply the invention to any connection devices. Thus, for example, the invention may be used in a plug type device, a socket connector, a plug type connector, a (printed circuit board) pin contact strip, a (PCB) header, and etcetera.

The electronic interface 1 generally includes a shield 2 and a contact assembly 4. The contact assembly 4 is mounted inside the shield 2, with the contact assembly 4 being retained by an engagement member inside the shield 2. The front region of the electronic interface 1, from which a mating connector (not illustrated in the drawings) can be moved forwards and inwards into the electronic interface 1, is referred to as the insertion side 6. First, the shield 2 of the electronic interface 1 (see FIGS. 1-4) is explained in greater detail below, then assembly and construction of the contact assembly 4 (see FIGS. 5, 6) and assembly of the contact assembly 4 in the shield 2 for the electronic interface 1 (see FIGS. 7, 8).

The shield 2 as shown generally includes two mutually distinguishable shield elements: a first shield element 20 and a second shield element 24. Firstly, at the front, the first shield element 20 which is also responsible for the insertion side 6 and which is also referred to as the interface shield 20. Then, at the rear, the second shield element 24 which is also responsible for assembly of the shield 2 and which is also referred to as the base shield 24. The first and second shield elements 20, 24 are arranged so as to be located one behind the other in the longitudinal direction L of the electronic interface 1, preferably directly one behind the other. In this instance, one or more slots 22 may exist between the first shield element 20 and the second shield element 24 and extend partially in the peripheral direction U of the electronic interface 1.

Spacing between the contact elements 412 is increased (see also FIGS. 5, 8) in an assembly region of the electronic interface 1. As a result, the base shield 24 has a greater dimension in at least one transverse direction Q or width direction Q of the electronic interface 1 than a corresponding region of the interface shield 20 in the same transverse direction Q. This can be seen, for example, on the left and at the front in FIG. 1 and on the right in FIG. 2. This results—apart from a movable two-part shielding—in the slot 22, which extends around at least a comparatively large peripheral region (approximately 270°), between the first and second shield elements 20, 24.

The first shield element 20 is spaced apart from the second shield element 24 along a length of the electronic interface 1 (longitudinal direction L). So, in order to achieve shielding, the first shield element 20 is connected to the second shield element 24 and, in particular they are electrically connected. In the shown embodiment, the first shield element 20 and the second shield element 24 are connected in at least two regions using comparatively wide devices or wide material portions. That is to say, the slot 22 provided in this instance is thereby closed, covered and/or partially filled with a material. If a cover is used, a small slot may be provided between the cover and a relevant side wall of the shield 2 (not shown). In this instance, it is preferable for the material portion and the relevant side wall to overlap.

Figure 4:
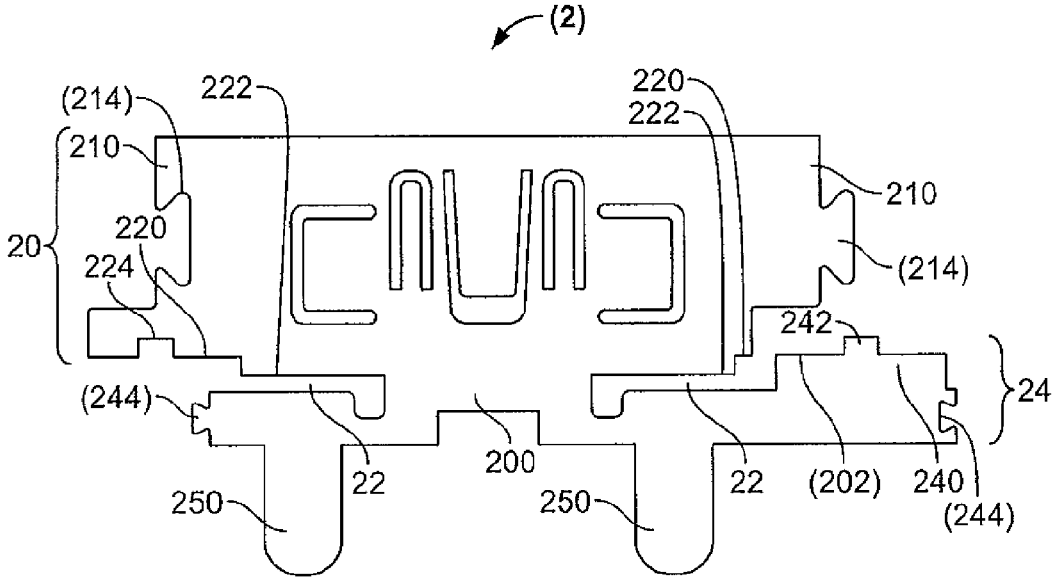
FIG. 4 is a plan view of a punching blank for the shield of the electronic interface from FIG. 1.

In a shown embodiment of FIG. 1, this is carried out using a first connection section 200. As shown, the first connection section 200 is an integral bridge between the first shield element 20 and the second shield element 24. As seen in FIG. 4, the base shield 24 is integral constructed with the interface shield 20 using the first connection section 200. As shown, the base shield 24 can taper, that is to say, curve away from the interface shield 20 (see FIGS. 1, 8).

As shown in FIG. 2, a second connection section 202 is provided between the first shield element 20 and the second shield element 24 and includes an electrical contact, resilient or clamping contacting system. In the embodiment shown in FIGS. 2-4, the base shield 24 includes a projection 240 or a shielding lug 240 which is bent towards the interface shield 20 or the side wall 210 thereof when a shield 2 is bent into shape. While a shielding lug 240 is discussed below, the term "projection" is also being intended to be included.

In this instance, the shielding lug 240 can contact the side wall 210 of the interface shield 20 by abutment of an edge or a rim therewith (not illustrated). It is further possible for an edge or a rim of the shielding lug 240 to abut an end of the interface shield 20 facing the base shield 24 (not illustrated, similar to FIG. 3). The interface shield 20 may have, at an end portion facing the base shield 24, a recess 220 in which the shielding lug 240 can be bent when the punching blank shown in FIG. 4 is bent into shape.

In this instance, an edge (not illustrated) or a rim (FIG. 3) of a free end of the shielding lug 240 may adjoin a rim (not illustrated) or an edge (FIG. 3) of the recess 220, under pretension, whereby an electrically conductive connection is brought about between the base shield 24 and the interface shield 20. The electromagnetic shielding action of the electronic interface 1 can thereby be significantly improved. In this instance, it is also conceivable to clamp the shielding lug 240 on/in the recess 220. That is to say, the shielding lug 240 may be in the form of a resilient lug and/or a clamping lug. Naturally, a transposed arrangement—that is to say, the shielding lug 240 at the interface shield 20 and the recess 220 in the base shield 24—may be used.

It is preferable for the first and second connection sections 200, 202 (i.e. shielding lug 240 and the substantially complementary recess 220) to be as wide as possible in the transverse direction Q, in order to bring about good electromagnetic protection. That is to say, the first and second connection sections 200, 202 extend substantially as far as the comparatively round corner regions of the shield 2 which partially confer on the electronic interface 1 and the insertion side 6 thereof its external shape. The same applies to a cover (not illustrated, see above) of the slot 22.

The shielding lug 240 may have a catch device 242, preferably a catch projection 242, in order to add electrical contact between the first and second shield elements 20, 24 and for securing the contact assembly 4 inside the shield 2 (see below, FIG. 8). Additionally, the interface shield 20 inside the recess 220 may have a catch device 224, preferably a catch receiving passageway 224.

When the shield 2 is in the state bent to shape, the catch projection 242 then engages in the catch receiving passageway 224 which is preferably in the form of a receiving passageway. In this instance, the catch projection 242 may be constructed in such a manner that it projects inwards into the shield 2, which may provide a securing shoulder or a securing projection or a securing spring for the contact assembly 4. Naturally, a transposed arrangement—that is to say, the catch projection 242 on the interface shield 20 and the catch receiving passageway 224 in the shielding lug 240—may be used.

Both the interface shield 20 and the base shield 24 are preferably mechanically closed using a positive-locking and/or non-positive-locking connection 214, 244, in particular a dovetail type connection 214, 244. In this instance, the mechanical connections 214, 244 are preferably arranged in a state offset relative to each other in the peripheral direction U. The mechanical connection 214 of the interface shield 20 is preferably provided centrally at one of the two largest sides of the shield 2 in terms of surface-area. The mechanical connection 234 of the base shield 24 is, however, preferably provided laterally at a corner region of the base shield 24. The base shield 24 may further have soldering connections 250 or connection pins 250 or connection legs 250 for a printed circuit board (not illustrated) opposite the interface shield 20.

Figure 5:
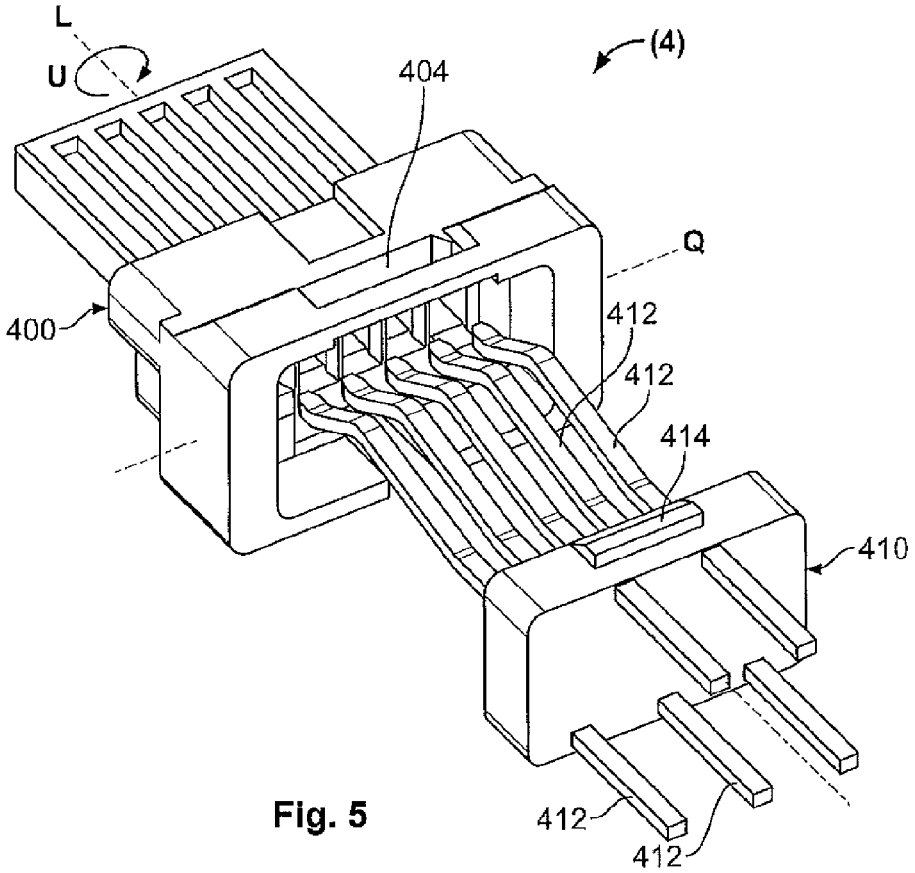
FIG. 5 is an exploded perspective a contact assembly of the electronic interface according to the invention.
Figure 6:
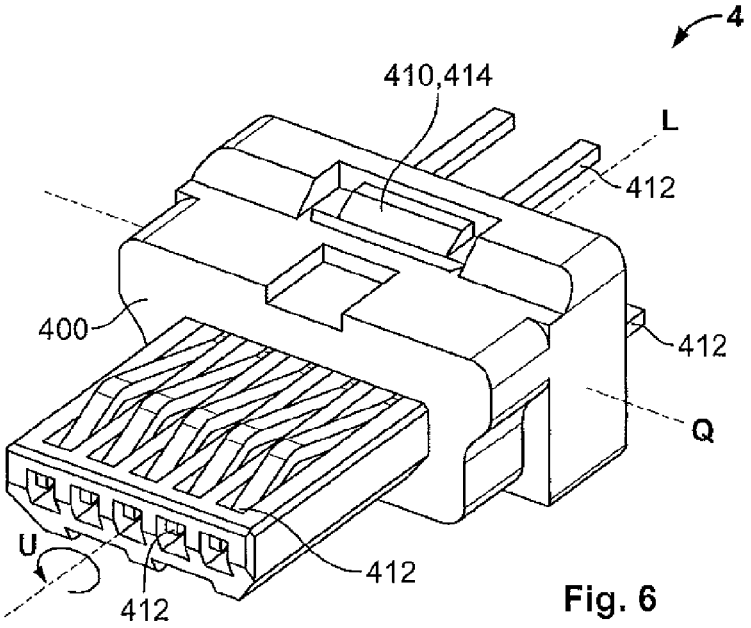
FIG. 6 is a perspective view of the contact assembly in FIG. 5.

FIGS. 5 and 6 show the contact assembly 4 having contact elements 412 and a contact carrier 410, and a contact receiving member 400. The contact elements 412 and a contact carrier 410 are brought forwards from the rear into the contact receiving member 400. In an end position, a catch device 414, such as a catch projection, of the contact carrier 410 engages on/in a catch device 404, such as a catch receiving passageway, of the contact receiving member 400. The contact elements 412 are, at the front, preferably in the form of contact springs or contact plates and, at the rear, in the form of connection pins. The contact receiving member 400 is constructed in such a manner that the contact elements 412 are retained at the free longitudinal end portions thereof and are guided in a resilient portion in the direction of a resilient path. Naturally, a configuration of the contact assembly 4 other than the configuration shown in FIGS. 5 and 6 is possible.

Figure 7:
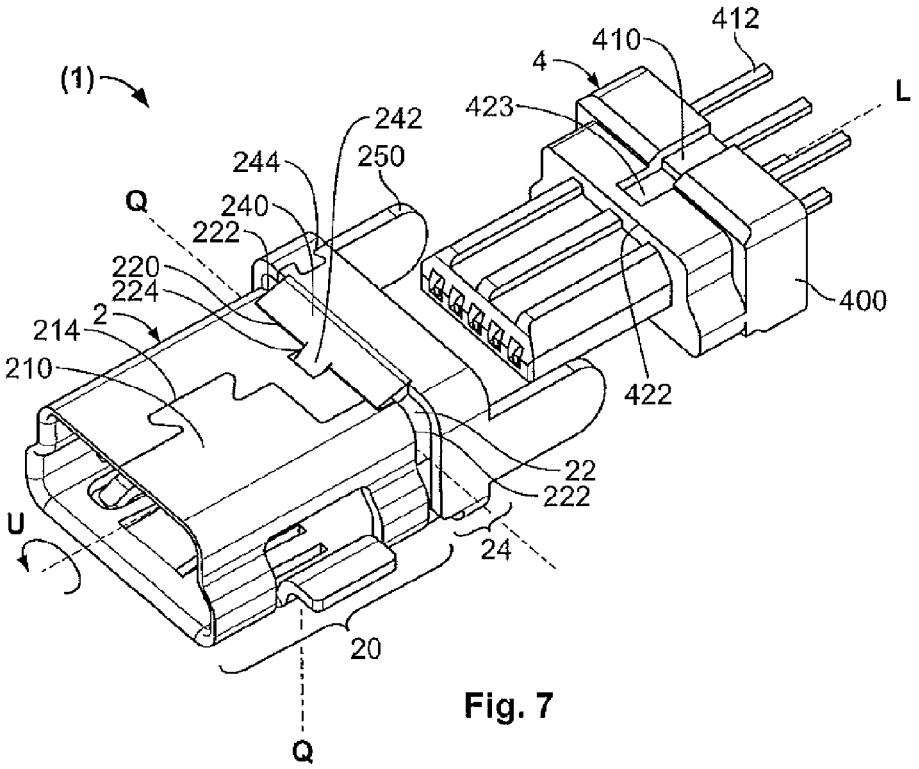
FIG. 7 is an exploded perspective view of the electronic interface showing pre-assembly of the contact assembly and the shield.

FIGS. 7 and 8 show assembly of the contact assembly 4 with the shield 2 to form the electronic interface 1. The contact assembly 4 is moved forwards from the rear and into the shield 2. In this instance, the contact assembly 4 is moved into the shield 2 until a portion of the contact assembly 4 abuts a stop 222 of the shield 2. Since the first shield element 20 in many regions is narrower than the base shield 24, it is preferable for the stop 222 to be along a front-end region of a wall of the interface shield 20, that front-end region facing the wall of the base shield 24.

Before the contact assembly 4 reaches the stop 222, the catch device 242 of the shielding lug 240 snap-fits behind a catch device 422, 423 of the contact receiving member 400. The catch device 422 is preferably in the form of a catch projection and the catch device 423 which cooperates therewith is preferably in the form of a catch receiving passageway. It is naturally possible to use only one catch projection 422 or one catch receiving passageway 423. The catch device 422, 423 is constructed in such a manner that the contact assembly 4 can be further moved forwards as far as the stop 222.

It is particularly possible not to provide the interface with contact springs but instead to provide as contact elements 412 which extend in a flat and planar manner (not illustrated) such as, for example, rectangular contact pads or strip conductors. For USB interfaces, this means that the invention can be applied to UBS plug type devices or USB connectors.

The foregoing illustrates some of the possibilities for practicing the invention. Many other embodiments are possible within the scope and spirit of the invention. The disclosed invention utilizes the above identified components in order to provide an electronic interface 1 for a particular purpose. Therefore, more or less of the aforementioned components can be used to conform to that particular purpose. It is, therefore, intended that the foregoing description be regarded as illustrative rather than limiting, and that the scope of the invention is given by the appended claims together with their full range of equivalents.

What is claimed is:

1. An electronic interface, comprising:

a shield comprising:

a first shield element having a catch receiving passageway;

a second shield element spaced apart from the first shield element along a length of the interface and having a width different than a width of the first shield element;

a connection section electrically connecting to the first shield element and the second shield element; and a second connection section positioned opposite the connection section between the first shield element and the second shield element, the second connection section including a projection extending toward a sidewall of the first shield element having a shield catch device extending from the projection and engaging the catch receiving passageway; and a contact assembly positioned inside the shield and having a contact catch device that snap-fits behind the shield catch device.

2. The electronic interface according to claim 1, wherein the connection section extends about a periphery of the first shield element and the second shield element.

3. The electronic interface according claim 1, wherein the first shield element is an interface shield.

4. The electronic interface according claim 3, wherein the second shield element is a base shield.

5. The electronic interface according claim 4, wherein the base shield is wider than the interface shield along a transverse section thereof.

6. The electronic interface according claim 1, wherein the connection section is integrally constructed with the first shield element and the second shield element.

7. The electronic interface according claim 1, wherein the second connection section extends from the second shield element and is releasably connected to the first shield element.

8. The electronic interface according claim 1, wherein the projection is a lug bent towards the first shield element.

9. The electronic interface according claim 1, wherein the shield further includes a stop.

10. The electronic interface according claim 1, wherein the contact catch device is a contact catch receiving passageway.

* * * * *